US006470615B1

(12) United States Patent
Peterken

(10) Patent No.: US 6,470,615 B1
(45) Date of Patent: Oct. 29, 2002

(54) VISIBLE FIREARM SAFETY AND DRY-FIRE DEVICE

(76) Inventor: William H. Peterken, P.O. Box 829, 163 Hidden Lake, Higganum, CT (US) 06411

( * ) Notice: Subject to any disclaimer, the term of this patent is extended or adjusted under 35 U.S.C. 154(b) by 0 days.

(21) Appl. No.: 09/702,081

(22) Filed: Oct. 30, 2000

(51) Int. Cl.[7] ..... F41A 17/44; F41A 17/74
(52) U.S. Cl. ..... 42/70.01; 42/70.08; 42/70.11
(58) Field of Search ..... 42/70.08, 70.01, 42/70.11

(56) References Cited

U.S. PATENT DOCUMENTS

| | | | | | |
|---|---|---|---|---|---|
| 3,089,272 | A | * | 5/1963 | McKinlay | 42/70.1 |
| 3,193,959 | A | | 7/1965 | Jaycox | 42/70.11 |
| 4,266,356 | A | * | 5/1981 | Jarvinen | 42/70.11 |
| 4,761,907 | A | * | 8/1988 | De Bernardini | 42/106 |
| 4,776,123 | A | | 10/1988 | Ascroft | 42/70.11 |
| 4,835,894 | A | * | 6/1989 | Libassi | 42/70.11 |
| 5,044,105 | A | * | 9/1991 | Lindley et al. | 285/80 |
| 5,070,635 | A | | 12/1991 | Cvetanovich | 42/70.11 |
| 5,097,613 | A | * | 3/1992 | Miller et al. | 42/1.05 |
| 5,115,589 | A | * | 5/1992 | Shuker | 42/70.11 |
| 5,315,778 | A | | 5/1994 | Wolford | 102/511 |
| 5,435,090 | A | * | 7/1995 | Darrow | 42/70.11 |
| 5,669,172 | A | * | 9/1997 | Goral | 42/66 |
| 5,680,724 | A | | 10/1997 | Peterken | 42/70.11 |
| 6,212,813 | B1 | * | 4/2001 | Luna et al. | 42/70.11 |
| 6,237,272 | B1 | * | 5/2001 | Scott | 42/70.11 |
| 6,250,008 | B1 | * | 6/2001 | Silver | 42/70.01 |

FOREIGN PATENT DOCUMENTS

| | | | | |
|---|---|---|---|---|
| GB | 2 215 822 | A | | 9/1989 |
| GB | 2286653 | A | * | 8/1995 |
| WO | WO-88/09475 | A1 | * | 12/1988 |
| WO | WO-96/28704 | A1 | * | 9/1996 |

* cited by examiner

*Primary Examiner*—Charles T. Jordan
*Assistant Examiner*—John W. Zerr
(74) *Attorney, Agent, or Firm*—Fattibene & Fattibene; Paul A. Fattibene; Arthur T. Fattibene

(57) ABSTRACT

An insert for a firearm having a large diameter portion extending a predetermined axial distance into a breech and a small diameter portion adapted to fit within the chamber of a barrel. The predetermined axial length of the larger diameter portion has a length long enough to prevent a hammer from striking a firing pin and short enough so that the hammer can be cocked and released by the trigger. In an embodiment a lock means prevents the insert from being removed from the firearm without authority. In another embodiment, a handle is used as a flag or for cocking. The firearm may be dry-fired for practice purposes without striking the firing pin. The insert is also readily visible so that a quick inspection of the firearm will confirm that the firearm is in a safe state. The present invention may be made to accommodate many different firearms and may also be used to safely dry-fire a firearm. The insert of the present invention also provides more realistic dry firing, greatly improving the effect of training.

23 Claims, 9 Drawing Sheets

VISIBLE FIREARM SAFETY AND DRY-FIRE DEVICE

FIELD OF THE INVENTION

The present invention relates in general to a safety device for a firearm that can readily be inserted therein, and particularly to a device readily visible in the firearm that prevents accidental discharge of the cartridge and permits dry-firing for practice.

BACKGROUND OF THE INVENTION

Firearms have been used for centuries, yet there is a continuing need to provide for the safe use thereof. While there are many safety devices for use with firearms, such as locks that attach to the trigger preventing the firearm from operating, they are often difficult to attach and may not function properly. Many locking devices still permit a cartridge to be placed within the chamber, increasing the risk of an unintentional discharge. Additionally, it is common to dry-fire a firearm for practice. This increases the risk of an unintentional discharge of the cartridge, as well as potentially damaging the firing pin during the dry-fire practice. A firearm safety insert that has solved many problems in the firearm safety art is disclosed in U.S. Pat. No. 5,680,724 entitled "Firearm Safety and Dry-Fire Device" issuing on Oct. 28, 1997 to William H. Peterken, which is herein incorporated by reference. Therein disclosed is a cylindrical insert having a recess in one end and a notch disposed between either end of the cylindrical insert for placement in the bolt carrier of a rifle or a firearm. While this device has been adequate for many applications, it is relatively large and often not clearly visible. This prevents a quick visible reference of the safety device, assuring its placement in the bolt carrier. Therefore, there is a need for an improved smaller firearm safety and dry-fire device that is readily visible and easily inserted into a firearm.

SUMMARY OF THE INVENTION

The present invention is an insert for use with firearms and primarily rifles that fits partially within the barrel of the rifle. The insert has a smaller diameter portion which fits in the barrel of the rifle and a larger diameter portion extending a predetermined distance into the breech of the rifle. The larger diameter portion extending into the breech has an axial length sufficient to permit the hammer to catch and be released by the trigger, but to prevent the hammer from striking the firing pin. Several embodiments include lock means for preventing the unauthorized removal of the insert from the firearm. Another embodiment includes a flag or handle to facilitate cocking.

Accordingly, it is an object of the present invention to provide a firearm safety and dry-fire device that can easily be inserted into the barrel and breech of a firearm and that is readily visible.

It is an advantage of the present invention that it permits dry-firing of the firearm for practice.

It is another advantage of the present invention that only a short movement is needed to reset the trigger during dry-firing practice.

It is a feature of the present invention that a larger diameter has a predetermined axial length to prevent the hammer from striking the firing pin and which minimizes the impact of the hammer when released.

It is another feature of the present invention that the predetermined axial length provides for a normal trigger release movement.

It is another feature of the present invention that lock means prevents unauthorized removal.

It is yet another feature of the present invention that it comprises a handle to facilitate cocking.

These and other objects, advantages, and features will become readily apparent in view of the following detailed description.

DETAILED DESCRIPTION OF THE PREFERRED EMBODIMENTS

Figure 1:
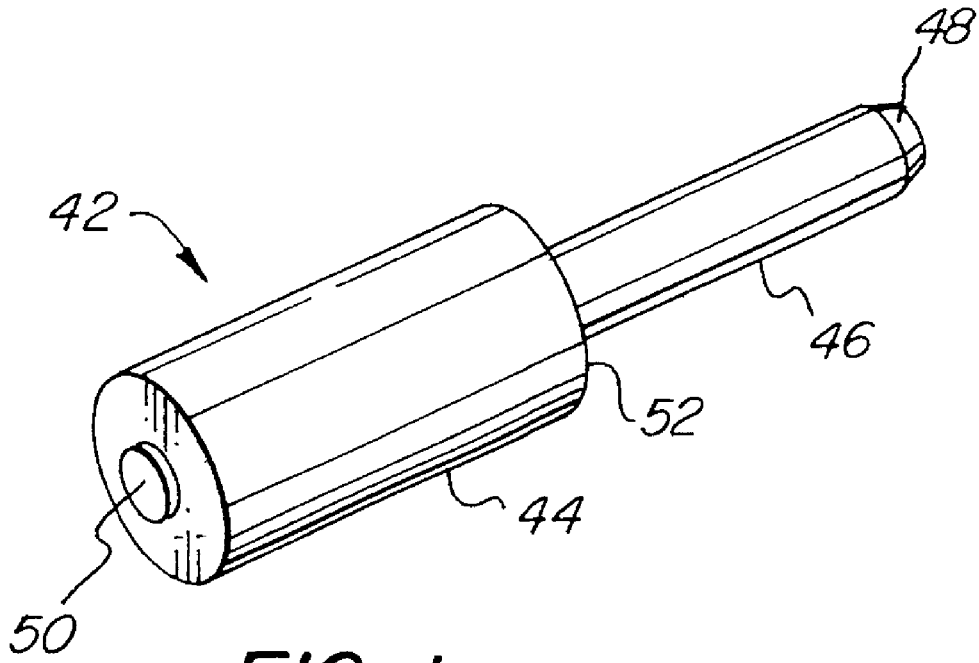
FIG. 1 is a perspective view illustrating the insert of the present invention.

FIG. 1 is a perspective illustration of an embodiment of the present invention. The visible firearm safety and dry-fire device or insert 42 has a large diameter portion 44 and a smaller diameter portion 46. Preferably, the small diameter portion 46 is slightly tapered to match or conform to the chamber of the barrel of a rifle. This taper or duplication of the relevant portion of the cartridge causes a precise fit between the device and the chamber for more positive and precise positioning. At the distal end of the small diameter portion 46 is a bevel 48. At the distal end of the larger diameter portion 44 is an appendage 50. Between the larger diameter portion 44 and the smaller diameter portion 46 is a shoulder or step 52. The shoulder or step 52 may be substantially perpendicular to the axis of rotation of the insert 42, or angled. If angled, the angle may match a dimension on the firearm and may range from between approximately forty-five and thirty degrees from a line perpendicular to the axis of rotation. The larger diameter portion may have an axial length greater than approximately two centimeters or three quarters of an inch.

Figure 2:
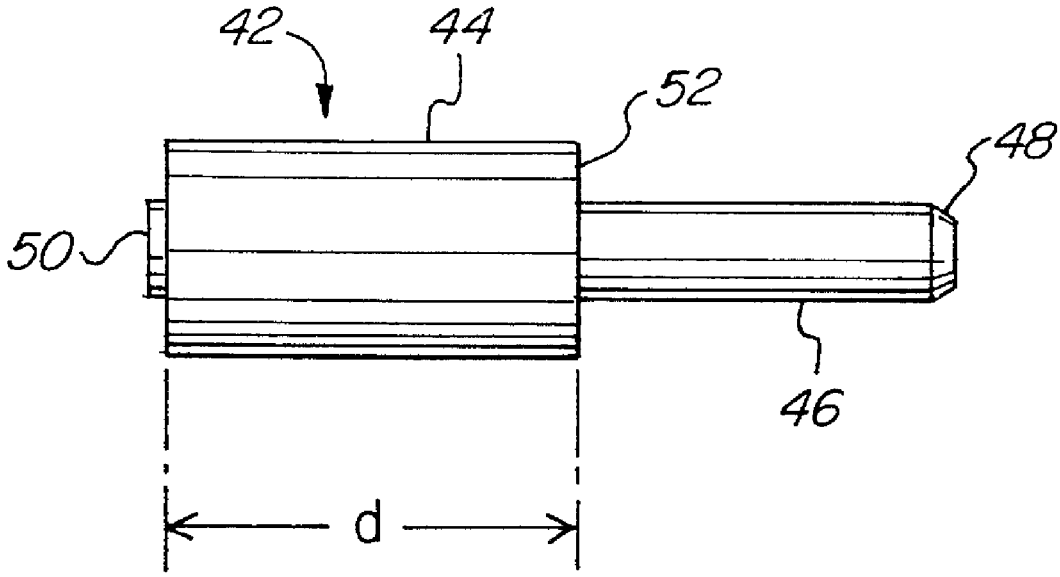
FIG. 2 is a side elevational view illustrating an embodiment of the present invention.

FIG. 2 is a side elevational view of an embodiment of the present invention illustrated in FIG. 1. FIG. 2 more clearly illustrates the distance d, which is the axial length of the larger diameter portion 44. The axial length d is a predetermined length based upon the particular firearm or rifle in which the insert 42 is to be placed. The distance d is determined so as to permit the hammer of the firearm to be cocked and released by the trigger, yet prevent the hammer from striking the firing pin.

Figure 3A:
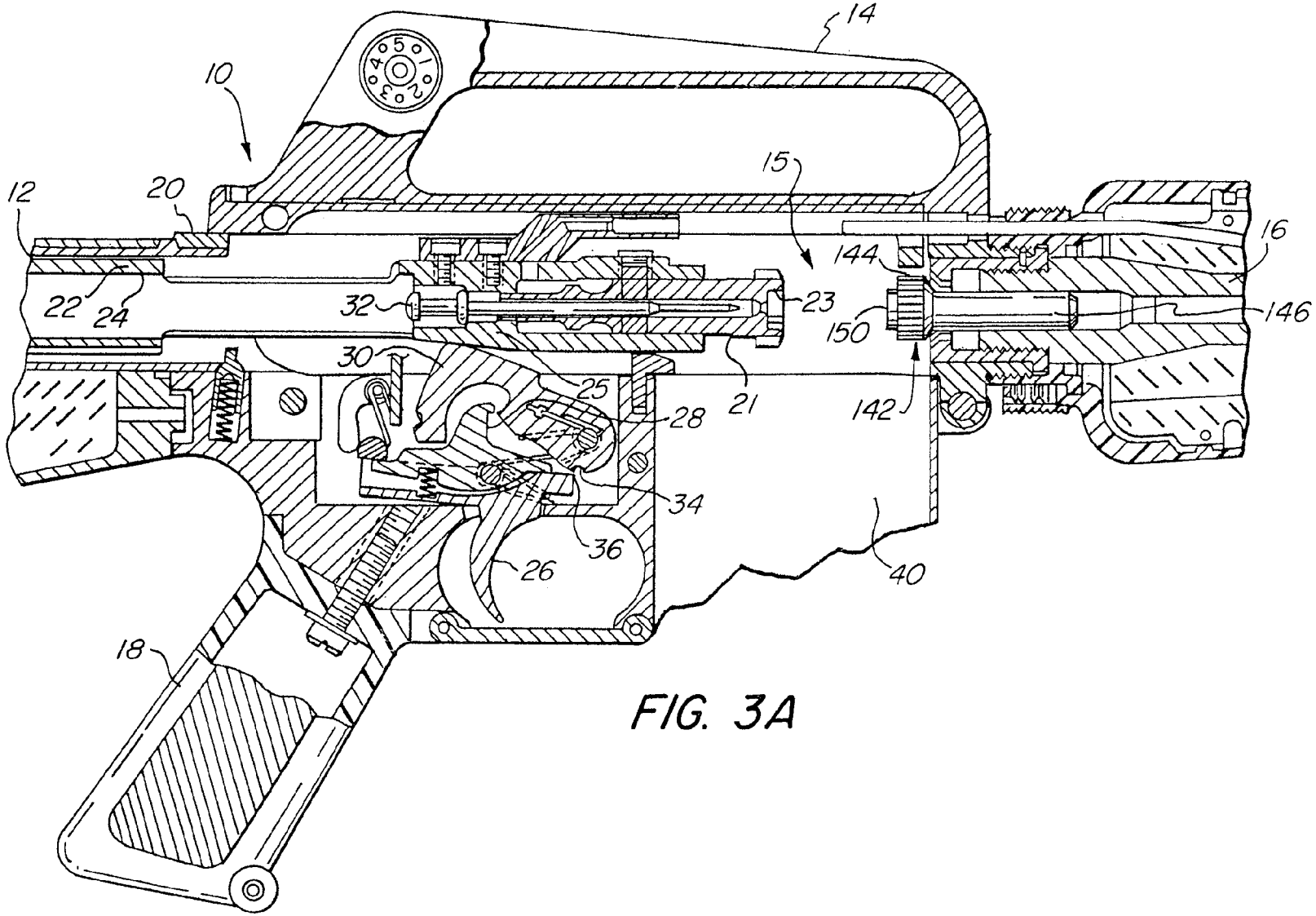
FIG. 3A schematically illustrates an embodiment of the present invention placed within a rifle.
Figure 3B:
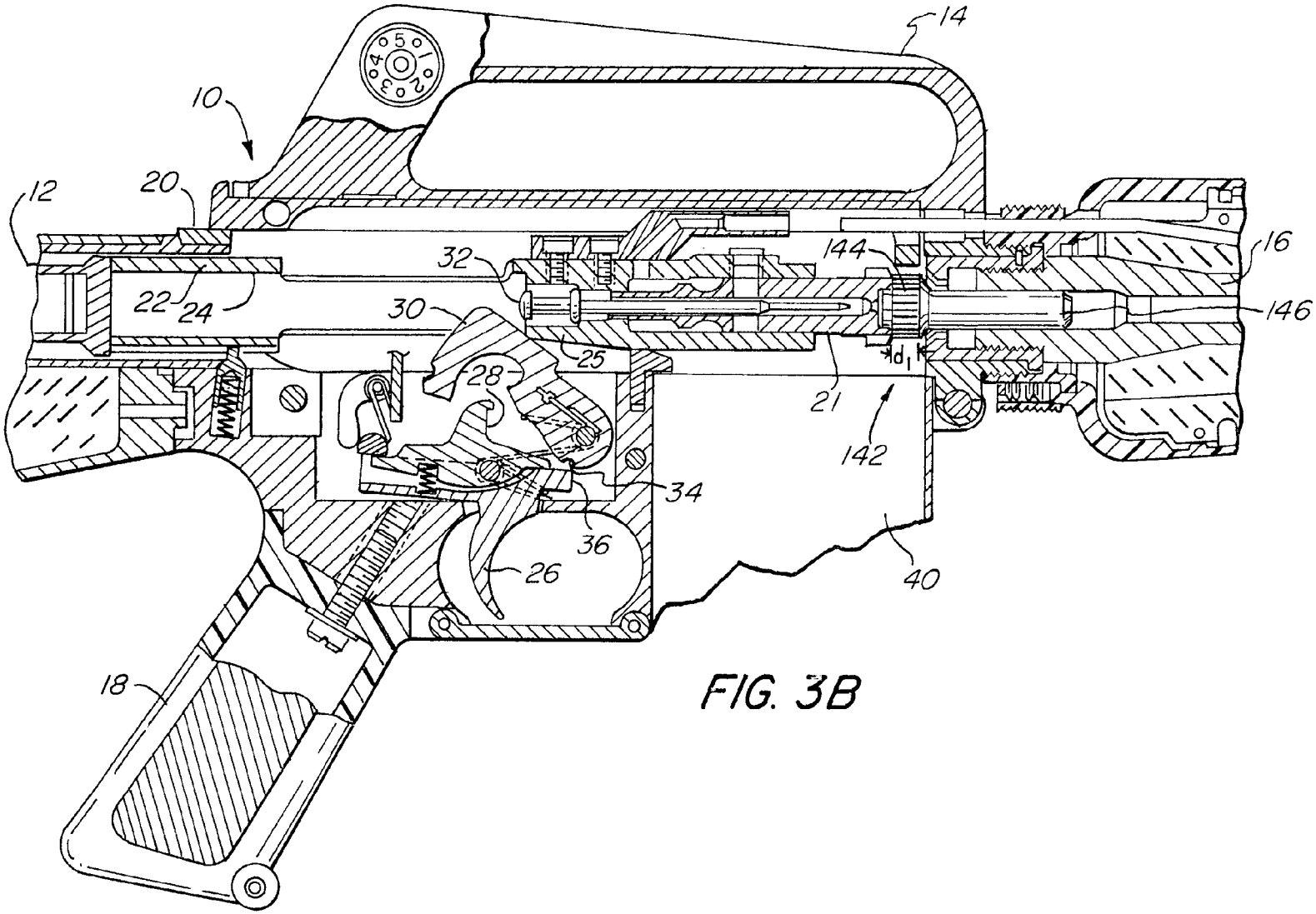
FIG. 3B schematically illustrates an embodiment of the present invention placed within a rifle, with the rifle in a slightly different position from the position illustrated in FIG. 3A.

FIGS. 3A and 3B better illustrate the operation of an embodiment of the present invention placed within a rifle. By way of example, an M16 rifle is generally illustrated. However, any firearm having a breech opening for which the insert of the present invention may be placed may be utilized, as for example, an M14, M1A or M1 rifle, among others. The rifle 10 is generally illustrated in a partial section with the butt stock 12 and barrel 16 shown only in part. The rifle 10 also generally has a handle 14 and a grip 18. An upper receiver 20 and a bolt carrier 22 are placed within the rifle. The bolt carrier 22 has a bore 24. The bolt carrier 22 is placed within the upper receiver 20 so as to slide back and forth or reciprocate. The bolt carrier 22 generally also contains a firing pin housing or bolt 21. The firing pin housing or bolt 21 is contained within the bolt carrier 22 and houses the firing pin 32. However, rear portion 25 is part of the bolt carrier 22 in which the firing pin housing or bolt 21 rides. Recess 23 is the bolt face, which is a recess. Placed within the firing pin housing or bolt 21 is a firing pin 32. As the bolt carrier 22 reciprocates rearward or to the left, hammer 30 is forced downward or is cocked such that a notch 34 thereon hooks or mates to an edge 36 on a portion of the trigger 26 attached to a disconnector 28. When the hammer 30 is released from the edge 36, the hammer swings upward. Generally, when the firearm 10 is intended to fire a cartridge, the hammer 30 would strike the firing pin 32, which in turn, would strike a cartridge firing a bullet. However, in the illustrations of FIGS. 3A and 3B, the insert 142 is in position so as to prevent the hammer 30 from striking the firing pin 32. Insert 142 is placed within the barrel 16 and the breech 15. The smaller diameter portion 146 is sized to fit within and is positioned within the chamber of the barrel 16. The larger diameter portion 144 extends axially a predetermined distance into the breech 15. Appendage 150 extends from the distal end of the larger diameter portion 144 and has a diameter to be received by the firing pin housing recess 23. Magazine chamber 40 would normally receive a magazine having cartridges therein.

FIG. 3B illustrates the rifle 10, as illustrated in FIG. 3A, with the firing pin housing or bolt 21 advanced adjacent the larger diameter portion 144 of the insert 142. The axial length of the larger diameter portion 144 is $d_1$. Because of the axial length $d_1$ of the larger diameter portion 144, the firing pin housing 21 is moved rearward or backward by the same distance $d_1$. Accordingly, the rear portion 25 of the bolt carrier 22 is caused to be more rearward or backward than it normally would be in a firing position. Accordingly, when hammer 30 is released by pulling the trigger 26, the hammer 30 strikes the rear portion 25 of the bolt carrier 22 rather than the firing pin 32. The required axial distance $d_1$ of the larger diameter portion 144 may vary depending upon the particular structure of the rifle for which the insert 142 is intended. However, this distance $d_1$ is readily ascertainable and is a function of the distance the rear portion 25 of the bolt carrier 22 must be moved rearward to prevent the hammer 30 from striking the firing pin 32. However, the distance $d_1$ must not be so great so as to prevent the hammer 30 from releasing when the trigger 26 is pulled. Accordingly, by sliding the bolt carrier 22 backward, and with it the associated firing pin housing 21, the hammer 30 may be cocked. When the bolt carrier 22 and the firing pin housing or bolt 21 is then advanced forward to abut or contact the larger diameter portion 144 of the insert 142, the rifle 10 may be dry-fired for practice without the hammer 30 striking the firing pin 32. This greatly improves firearm reliability and prevents breakage of firing pins, which is typically associated with dry-firing.

The diameter of the small diameter portion 146 should be sized so as to fit within the chamber of the barrel for which it is to be placed. Additionally, the axial length of the small diameter portion 146 need only be sufficiently long so as to securely be retained within the bore of the barrel 16. The larger diameter portion 144 may have a diameter so as to fit within the breech 15 and provide a support for the end of the firing pin housing 21. The axial distance $d_1$ must be sufficiently long to prevent the hammer 30 from striking the firing pin 32, yet sufficiently short so that the hammer 30 can be released by pulling the trigger 26 so that the rifle 10 may be dry-fired for practice. Typically, the insert 142 may be made of a plastic material such as a polymer, for example DELRIN, and may be made in any color such as black or yellow for high visibility. When the present invention is inserted into a firearm, the hammer cannot hit the firing pin and ammunition or a cartridge cannot be introduced into the chamber or barrel. This makes storage and training with firearms much safer. Additionally, training is enhanced with the use of the present invention because the user doesn't need to break position to reset the trigger mechanism. This results in improved trigger technique and enhanced ability to assess site picture at release and during follow-through.

FIGS. 4A–E illustrate another embodiment of the device of the present invention in a different type of firearm. The present invention can be applied to a variety of different firearms, depending upon dimensioning of the device so as to be adapted to the different firearms.

Figure 4A:
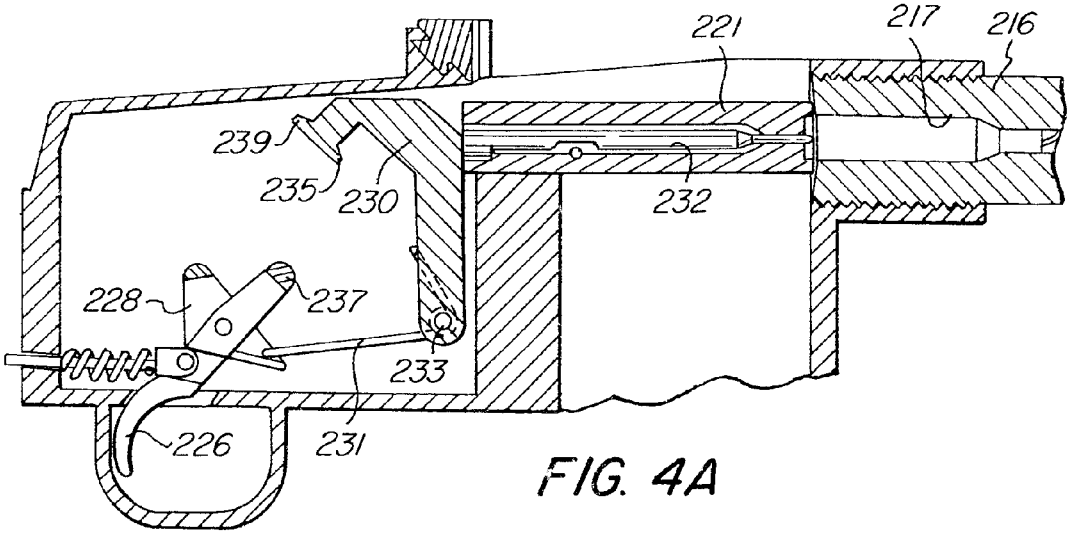
FIG. 4A schematically illustrates another type of rifle.

FIG. 4A schematically illustrates the operation of a firearm without the device of the present invention inserted therein. The barrel 216 has a chamber 217 therein. A cartridge is typically placed within the chamber 217. A bolt or firing pin housing 221 has a firing pin 232 contained therein. A hammer 230 is pivoted on pivot pin 233 and biased forward or towards the firing pin 232 by spring 231. The hammer 230 has a forward hook 235 and a rearward hook 239. A trigger 226 and sear portion of the trigger 237 engage the forward hook 235 of the hammer 230 when the hammer 230 is engaged with the trigger 226 mechanism. Disconnector 228 may also engage with the rear hook 239 of the hammer 230. In operation, when trigger 226 is pulled, the sear portion 237 rotates forward, disengaging the forward hook 235 of hammer 230, causing the hammer 230 to rotate on pivot pin 233, striking the firing pin 232 causing a cartridge, not illustrated, inserted in the chamber 217 to fire.

Figure 4B:
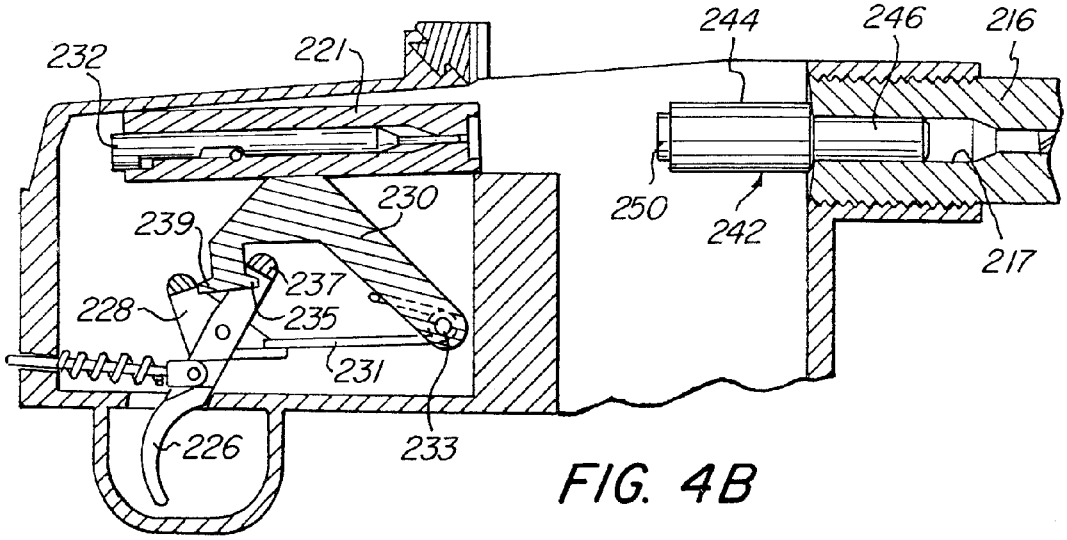
FIG. 4B schematically illustrates an embodiment of the present invention adapted for use in the other type of rifle illustrated in FIG. 4A.

FIG. 4B illustrates an embodiment of the present invention inserted into the firearm illustrated in FIG. 4A. The visible dry-fire and safety device insert 242 is placed within the firearm by fully retracting the bolt or firing pin housing 221. The smaller diameter portion 246 is placed within the chamber 217. The larger diameter portion 244 extends into the breech of the firearm. The axial dimension or axial length of the larger diameter portion 244 has a predetermined dimension so as to permit cocking and dry firing of the firearm without the hammer 230 striking the firing pin 232. Appendage 250 is adapted to fit within a recess of the firing pin housing 221. The hammer 230 is pivoted rearward by the bolt or firing pin housing 221 and is caused to engage the trigger mechanism. With the bolt or firing pin housing 221 fully displaced to the rear, there is sufficient space to install and remove the insert 242. It should be noted that the hammer 230 is rotated beyond the distance required to reset the trigger 226. Generally, the firing pin housing or bolt 221 may be cycled or moved the full travel available. This is generally so as to strip a cartridge from the magazine and into the chamber. However, since this is not the goal of dry-firing, it is only necessary to cycle the firing pin housing or bolt 221 sufficiently to introduce the insert 242 into the chamber and reset the trigger after each release. Accordingly, there is a slight distance between the sear 237 portion of the trigger and the forward hook 235 of the hammer 230.

Figure 4C:
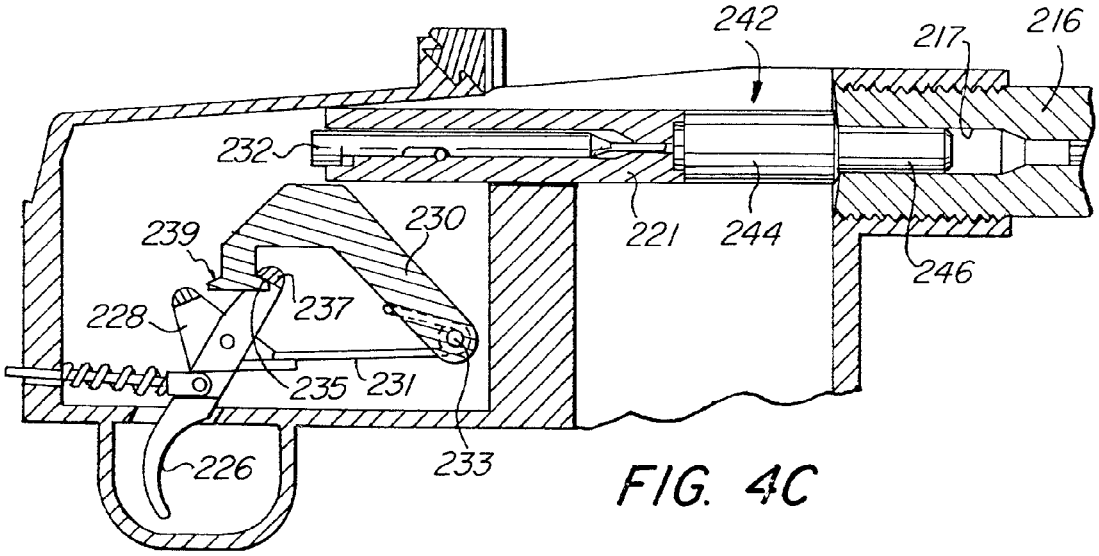
FIG. 4C schematically illustrates an embodiment of the present invention adapted for use in the other type of rifle illustrated in FIG. 4A and in a position ready to dry-fire.

FIG. 4C schematically illustrates the firing pin housing or bolt 221 advanced adjacent the insert 242 and the trigger set or hammer 230 cocked. The sear portion 237 of the trigger is engaged with the forward hook 235 of the hammer 230. The spring 231 causes an upward pressure, keeping the hammer 230 cocked. There is a gap between the upper portion of the hammer 230 and the lower portion of the firing pin housing or bolt 221. This gap allows the hammer 230 to be released in a normal manner when the trigger 226 is pulled. This gap allows the hammer 230 to swing up and make a positive contact or click when it impacts the bottom of the firing pin housing or bolt 221. The axial distance or length of the large diameter portion 244 has a predetermined length or distance so as to cause the firing pin housing or bolt 221 to move backward a predetermined distance sufficient to place the bolt in a position so that the hammer is permitted to release normally with a normal trigger pull and to impact or strike the bottom portion of the firing pin housing or bolt 221. The hammer therefore does not impact the firing pin 232. The small gap results in a short swing, minimal impact, with no impact damage to the hammer 230 or bolt or firing pin housing 221. There is no jarring to disturb the point of aim, permitting better follow though and improved sight picture.

Figure 4D:
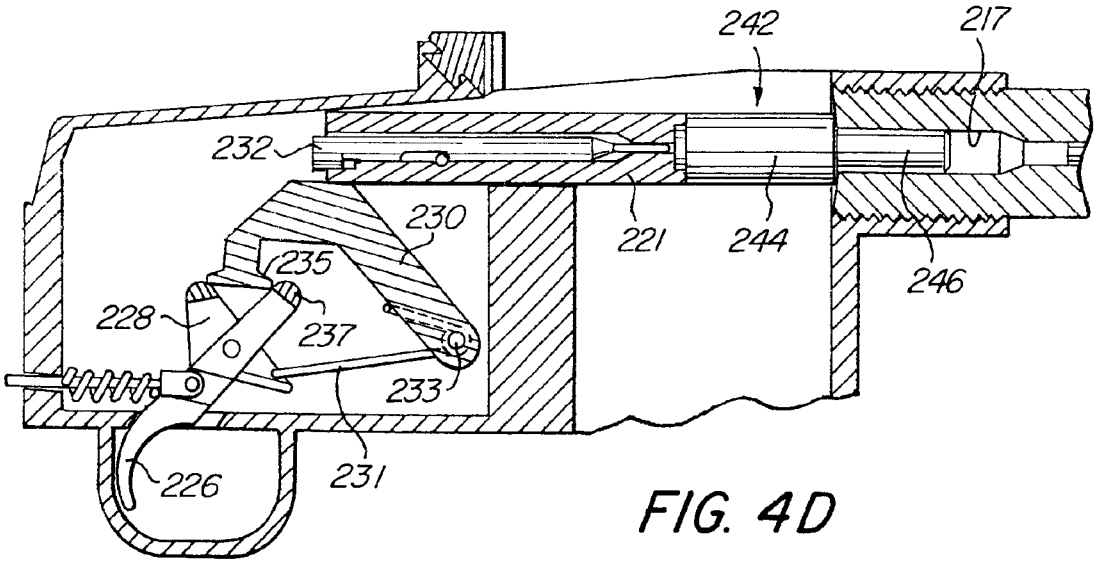
FIG. 4D schematically illustrates an embodiment of the present invention adapted for use in the other type of rifle illustrated in FIG. 4A and in a position after being dry-fired.

FIG. 4D schematically illustrates the insert 242 in position and the hammer 230 released or dropped and impacting the bottom portion of the firing pin housing or bolt 221. The hammer 230 impacting the bottom portion of the firing pin housing or bolt 221 prevents the hammer 230 from impacting the firing pin 232. This low impact of the hammer 230 permits the shooter to better evaluate site picture, follow through and trigger technique. Impact damage to the firing pin is also prevented.

Figure 4E:
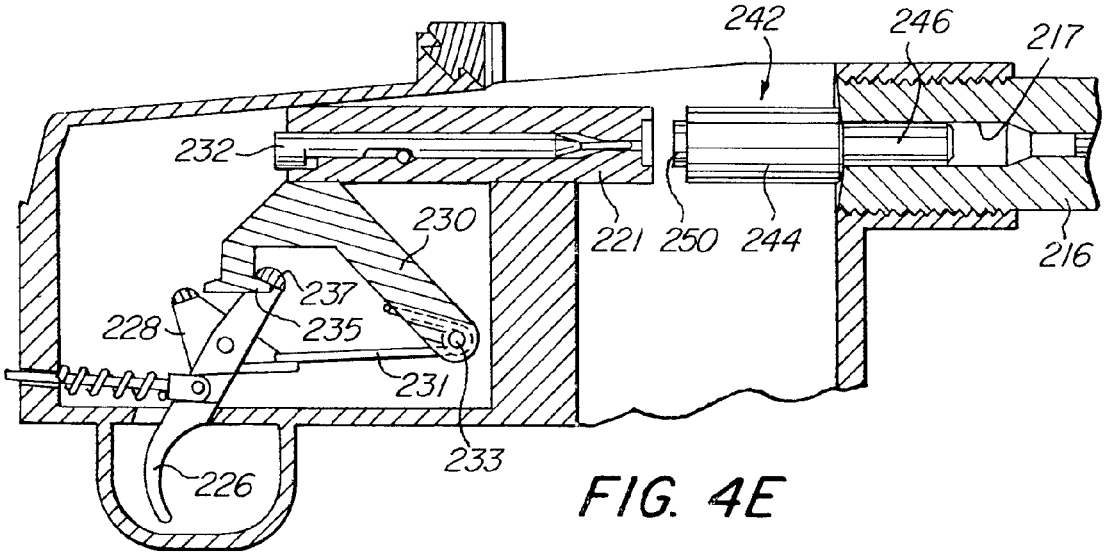
FIG. 4E schematically illustrates an embodiment of the present invention adapted for use in the other type of rifle illustrated in FIG. 4A and in a position resetting the trigger.

FIG. 4E schematically illustrates displacement of the firing pin housing or bolt 221 to the rear in order to reset the trigger mechanism. Only a small distance of rearward movement is required to reset the trigger mechanism. Because the bolt moves only about one-quarter of an inch or 0.6 cm, the insert 244 cannot fall out of the chamber 217. In this example, the movement of the firing pin housing or bolt 221 at a small angle rotates the hammer 230 a distance sufficient to cause the hammer forward hook 235 to engage the sear portion 237 of the trigger 226. The trigger is displaced and caused to return by spring pressure permitting the forward hook 235 of the hammer 230 to engage the sear portion 237. Accordingly, movement of the firing pin housing or bolt 221 a limited distance rearward of the insert 242 permits the user to conveniently reset the trigger without breaking position. This makes dry- fire training more convenient. The firing pin housing or bolt 221 can be moved further to the rear, but is only necessary to remove the insert 242.

Figure 5:
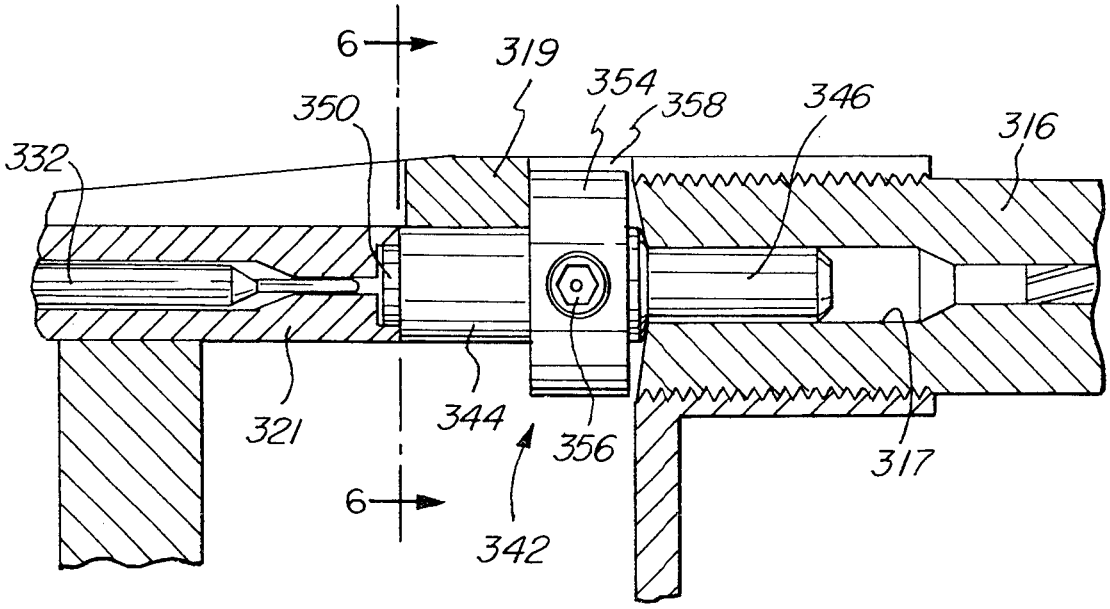
FIG. 5 is a partial cross section illustrating a locking embodiment of the present invention.
Figure 6:
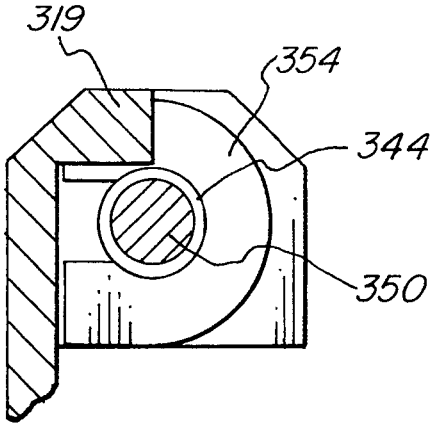
FIG. 6 is a cross section taken along line 6—6 in FIG. 5.

FIG. 5–6 illustrates another embodiment of the present invention having a lock means for retaining the insert in the firearm. In this embodiment, the insert 342 has a saddle 354 placed around the larger diameter portion 344 of insert 342 and is attached thereto by screw or bolt 356. The saddle 354 is held within the locking recess 35S8 formed between the shoulder 319 and the barrel 316. Shoulder 319 is formed in the receiver or frame of the firearm to which the barrel 316 is attached. This prevents the insert 342 from being removed from the chamber 317. Appendage 350 fits within a recess in the firing pin housing 321, in which the firing pin 332 is held. The screw or bolt 356 may have a proprietary head thereon so as to prevent unauthorized removal. FIG. 6 is a partial cross section taken along line 6—6 in FIG. 5. FIG. 6 more clearly illustrates the saddle 354 in position.

Figure 7:
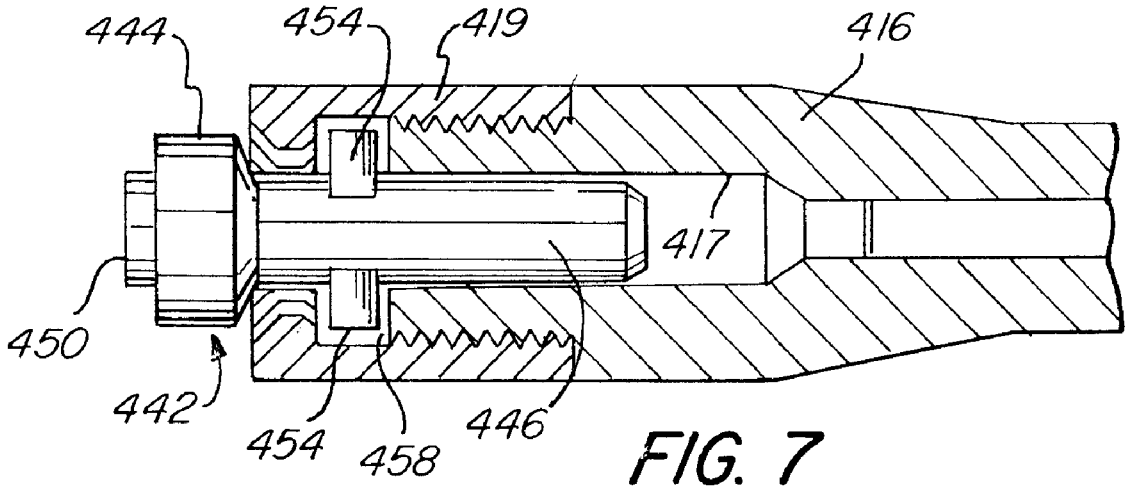
FIG. 7 is a partial cross section illustrating another locking embodiment of the present invention.
Figure 8:
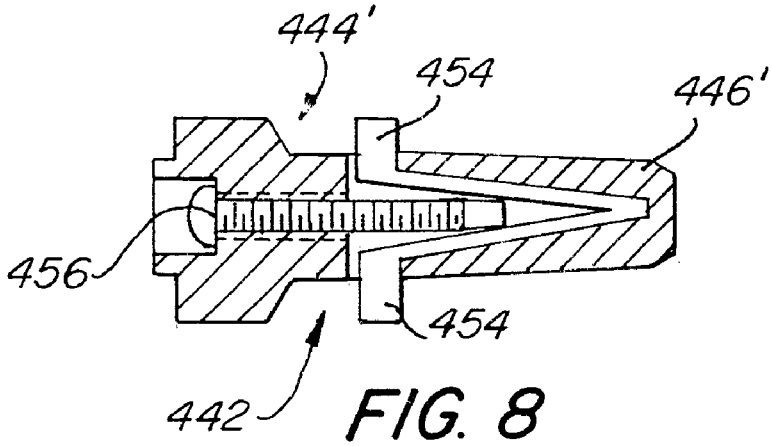
FIG. 8 is a cross section schematically illustrating the locking embodiment of the present invention illustrated in FIG. 7.
Figure 9:
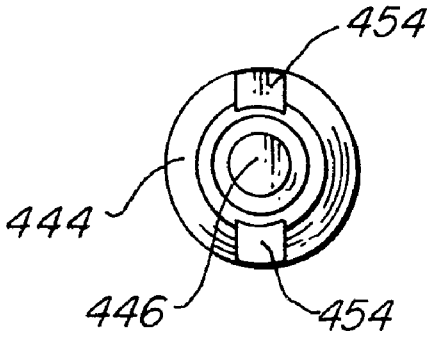
FIG. 9 is a front elevational view of the embodiment illustrated in FIG. 8.

FIGS. 7–9 illustrate another embodiment of a lock means for retaining the insert within the firearm. FIG. 7 is a partial cross section illustrating the insert 442 positioned within a chamber 417 in a barrel 416. A barrel extension 419 is placed on barrel 416 so as to form a locking recess 458. The barrel extension 419 is a normal part of the assembly in many firearms. Wings 454 on the smaller diameter portion 446 of the insert 442 are caused to extend into the locking recess 458. The larger diameter portion 444 is held outside of the barrel 416 and has an appendage 450 thereon. FIG. 8 is a partial cross section of the insert 442. A screw 456 is placed through the rear portion 444' and into the forward portion 446'. The screw 456 may have a proprietary head to prevent unauthorized removal. Wings 454 are move radially inward or outward as the screw 456 is rotated. As screw 456 goes in wings 454 are wedged:outward. The wings 454 retract when screw 456 is retracted. The wings 454 are springy and may be made of a spring steel. FIG. 9 is a front view more clearly illustrating the wings 454.

Figure 10:
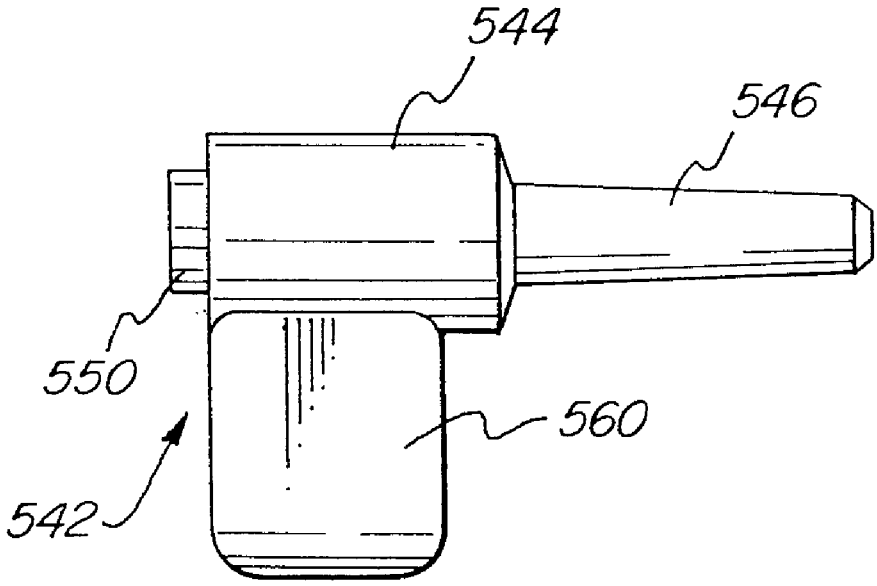
FIG. 10 is a side elevational view of another embodiment of the present invention.
Figure 11:
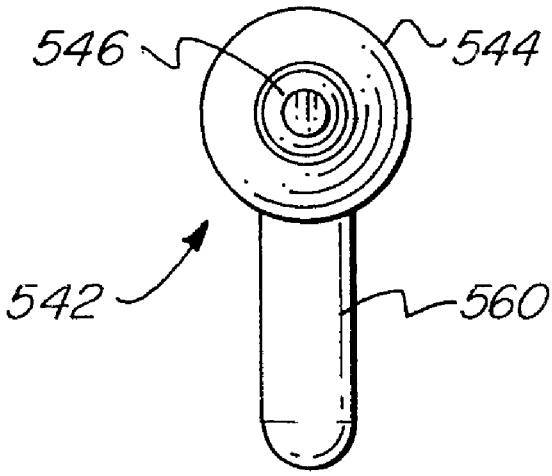
FIG. 11 is a front view of the embodiment illustrated in FIG. 10.

FIGS. 10–11 illustrate another embodiment of the present invention having an extension, handle, or flag. FIG. 10 is a side elevational view illustrating the insert 542 having a larger diameter portion 544 and a smaller diameter portion 546. Appendage 550 is formed on the rear portion of the larger diameter portion 544. Attached, perpendicularly with respect to the axial dimension of the insert 542, is a handle 560. The handle 560 may be used as a safety flag for protruding from the ejection port of a firearm, for example an M16 or AR-15 type firearm. In other firearms, such as an M14, M1A or M1, the flag or handle 560 may protrude from the open or top of the receiver. This embodiment of the insert 542 may function as an open bolt indicator, unloaded indicator, in addition to being a dry-fire device. Alternatively, the handle 560 may be sufficiently strong so as to function as a cocking handle, permitting the handle to be used to return or retract the bolt and reset the trigger. This may be more convenient than using the charging handle, as an example in an M16 or AR-15, where the charging handle is located at the rear of the receiver. The handle 560 may also facilitate installation and removal of the insert 542 in the firearm. For example, in some firearms the insert may be placed through the ejection port. The handle may also be colored to be more visible, or to function as a flag for an open bolt indicator or unloaded indicator. FIG. 11 is a front view more clearly illustrating the shape of the handle 560 of the device 542. The handle 560 may be made longer or shorter depending upon the application. Additionally, if the handle is used as a cocking handle the thickness may be increased for strength.

The present invention is a simple, easy to install device that greatly enhances firearm safety and practice. The visibility of the device quickly assures a user that the firearm is not loaded. The device may be easily dimensioned to fit and operate with many different firearms.

While various embodiments have been illustrated and described, it should be appreciated by those skilled in the art that various modifications may be made without departing from the spirit and scope of this invention.

What is claimed is:

1. An insert for a firearm comprising:

a first portion adapted to fit within a chamber of a barrel of the firearm;

a second portion adjacent said first portion, said second portion having a lateral dimension being greater than a diameter of said chamber, and said second portion having a predetermined axial length sufficient to prevent a hammer of the firearm from striking a firing pin of the firearm and permitting the hammer of the firearm to be cocked and subsequently released by pulling a trigger of the firearm when said first portion is placed within the chamber of the firearm, whereby the firearm is capable of being dry-fired without damaging the firing pin of the firearm and maintaining normal trigger function.

2. An insert for a firearm as in claim 1 further comprising:

an appendage attached to a distal end of said second portion.

3. An insert for a firearm as in claim 1 further comprising:

lock means, attached to the insert, for preventing unauthorized removal of the insert.

4. An insert for a firearm as in claim 3 wherein:

said locking means comprises a saddle removably attached to said second portion.

5. An insert for a firearm as in claim 3 wherein:

said locking means comprises laterally extending wings.

6. An insert for a firearm as in claim 1 further comprising:

a handle extending from said second portion.

7. An insert for a firearm as in claim 1 wherein:

said second portion has an axial length greater than approximately two centimeters or three quarters of an inch.

8. An insert for a firearm as in claim 1 wherein:

said insert is yellow.

9. An insert for a firearm as in claim 1 wherein:

an end of said second portion adjacent said first portion is angled between ninety and sixty degrees from a longitudinal axis of the insert.

10. An insert for a firearm comprising:

a first diameter portion adapted to fit within a chamber of a barrel of the firearm; and a second diameter portion adjacent said first diameter portion, said second diameter portion being larger than said first diameter portion, and said second diameter portion having a predetermined axial length sufficient to prevent a hammer of the firearm from striking a firing pin of the firearm and permitting the hammer of the firearm to be cocked and subsequently released by pulling a trigger of the firearm when said first diameter portion is placed within the chamber of the firearm.

whereby the firearm is capable of being dry-fired without damaging the firing pin.

11. An insert for a firearm as in claim 10 further comprising:

an appendage attached to a distal end of said second portion, said appendage adapted to fit within a recess on a firing pin housing of the firearm.

12. An insert for a firearm as in claim 10 further comprising:

lock means, attached to the insert, for preventing unauthorized removal of the insert.

13. An insert for a firearm as in claim 10 further comprising:

a handle extending from said second diameter portion.

14. An insert for a firearm as in claim 10 wherein:

an end of said second diameter portion adjacent said first diameter portion is angled between ninety and sixty degrees from a longitudinal axis of the insert.

15. An insert for a firearm comprising:

a first diameter portion adapted to fit within a chamber of a barrel of the firearm;

a second diameter portion adjacent said first diameter portion, said second diameter portion being larger than said first diameter portion, and said second diameter portion having a predetermined axial length sufficient to prevent a hammer of the firearm from striking a firing pin of the firearm and permitting the hammer of the firearm to be cocked and subsequently released by pulling a trigger of the firearm when said first diameter portion is placed within the chamber of the firearm; and a lock attachment, said lock attachment attached to the insert whereby an unauthorized removal of the insert is prevented.

16. An insert for a firearm as in claim 15 wherein:

said lock attachment comprises a removably attached saddle.

17. An insert for a firearm as in claim 15 wherein:

said lock attachment comprises radially extending wings.

18. An insert having an axis of rotation for a firearm comprising:

a first diameter portion adapted to fit within a chamber of a barrel of the firearm;

a second diameter portion adjacent said first diameter portion, said second diameter portion being larger than said first diameter portion, and said second diameter portion having a predetermined axial length sufficient to prevent a hammer of the firearm from striking a firing pin of the firearm and permitting the hammer of the firearm to be cocked and subsequently released by pulling a trigger of the firearm when said first diameter portion is placed within the chamber of the firearm; and a handle extending perpendicularly from the axis of rotation of the insert, whereby the handle extends from a breech of the firearm.

19. A firearm and visible safety and dry fire device comprising:

a barrel having a chamber;

a bolt reciprocally mounted in the firearm so as to move toward and away from said barrel;

a firing pin placed within said bolt;

a trigger;

a sear portion attached to said trigger;

a hammer, said hammer releasably coupled to said sear, whereby said hammer is released when said trigger is moved; and an insert having a first portion placed within said chamber and a second portion extending out of said chamber a predetermined distance so that when said hammer is released by said sear, said hammer hits said bolt without striking said firing pin and said bolt can be reciprocated sufficiently to reset said hammer on said sear ready to be released by pulling said trigger, whereby a cartridge cannot be placed within said firearm and said firearm can be dry fired without damage to said firing pin, hammer, or bolt.

20. A firearm and visible safety and dry fire device as in claim 19 further comprising:

lock means, attached to said insert, for preventing unauthorized removal of said insert.

21. A firearm and visible safety and dry fire device as in claim 19 further comprising:

a handle attached to said insert, whereby said handle extends from said firearm.

22. An insert for a firearm comprising:

a first portion adapted to fit within a chamber of a barrel of the firearm;

a second portion adjacent said first portion, said second portion having a lateral dimension being greater than a diameter of said chamber, and said second portion having a predetermined axial length sufficient to prevent a hammer of the firearm from striking a firing pin of the firearm when said first portion is placed within the chamber of the firearm; and an appendage attached to a distal end of said second portion and having an appendage diameter adapted to be received by a firing pin recess in a firing pin housing on the firearm, whereby the firing pin recess is capable of engaging said appendage as the firing pin housing is advanced permitting dry firing of the firearm.

23. An insert for a firearm permitting the firearm to be dry-fired comprising:

a first portion adapted to fit within a chamber of a barrel of the firearm; and a second portion adjacent said first portion, said second portion having a lateral dimension being greater than a diameter of said chamber, and said second portion having a predetermined axial length so as to cause a bolt of said firearm to move backward a predetermined distance sufficient to place the bolt in a position so that a hammer of the firearm is permitted to release normally with a normal trigger pull and to impact a bottom portion of the bolt, whereby the firearm is capable of being dry-fired resulting in the hammer not impacting a firing pin of the firearm and a minimum impact to the hammer and bolt with no jarring to disturb a point of aim permitting better follow through and improved sight picture.

* * * * *